United States Patent [19]

Canfield

[11] Patent Number: 5,032,957

[45] Date of Patent: Jul. 16, 1991

[54] CABINET LIGHT

[76] Inventor: David Canfield, 263 Apple Blossom La., Pataskala, Ohio 43062

[21] Appl. No.: 512,331

[22] Filed: Apr. 23, 1990

[51] Int. Cl.[5] ..... A47B 97/00

[52] U.S. Cl. ..... 362/133; 362/155

[58] Field of Search ..... 362/133, 155, 276, 802, 362/157; 312/223

[56] References Cited

U.S. PATENT DOCUMENTS

| | | | |
|---|---|---|---|
| 2,156,462 | 5/1939 | Schulte | 362/191 |
| 2,279,933 | 4/1942 | Wells | 362/191 |
| 2,411,100 | 11/1946 | Macdonald | 362/155 |
| 2,774,860 | 12/1956 | Prebol et al. | 362/191 |
| 2,813,195 | 11/1957 | Willey et al. | 362/802 |
| 3,800,134 | 3/1974 | Castaldo | 362/155 |
| 4,178,626 | 12/1979 | Marcus | 362/133 |
| 4,332,007 | 5/1982 | Gibstein et al. | 362/156 |
| 4,413,364 | 11/1983 | Bittaker et al. | 362/802 |
| 4,414,611 | 11/1983 | Seltzer et al. | 362/802 |
| 4,442,478 | 4/1984 | Stansbury | 362/133 |
| 4,554,618 | 11/1985 | Bafunno et al. | 362/155 |
| 4,577,262 | 3/1986 | Buteaux | 362/155 |
| 4,648,012 | 3/1987 | Pittman, II | 362/155 |
| 4,754,376 | 6/1988 | Winslow | 362/191 |
| 4,755,915 | 7/1988 | Rogers | 362/155 |
| 4,860,178 | 8/1989 | Picon | 362/802 |
| 4,872,095 | 10/1989 | Dubak et al. | 362/155 |

*Primary Examiner*—Ira S. Lazarus
*Assistant Examiner*—Richard R. Cole
*Attorney, Agent, or Firm*—Watkins, Dunbar & Pollick

[57] ABSTRACT

A battery operated self-activated illumination device for cabinet assemblies as a housing within an illuminating section that is open on four sides so as to allow light from a light source to project through each of the four open sides so as to fully illuminate the interior of the cabinet. A plunger switch is provided which interacts with the door of the cabinets so as to cause the light to be activated on opening the door. A second switch is interposed in the circuitry so as to enable turning the light on and off independent of the plunger switch. A four sided transparent lens covers the housing and the illuminating device fastened to the cabinet using an adhesive such as a double-sided adhesive tape. A battery is contained within the housing illuminating device and is readily accessible for replacement by means of a battery cover.

22 Claims, 3 Drawing Sheets

FIG. 5
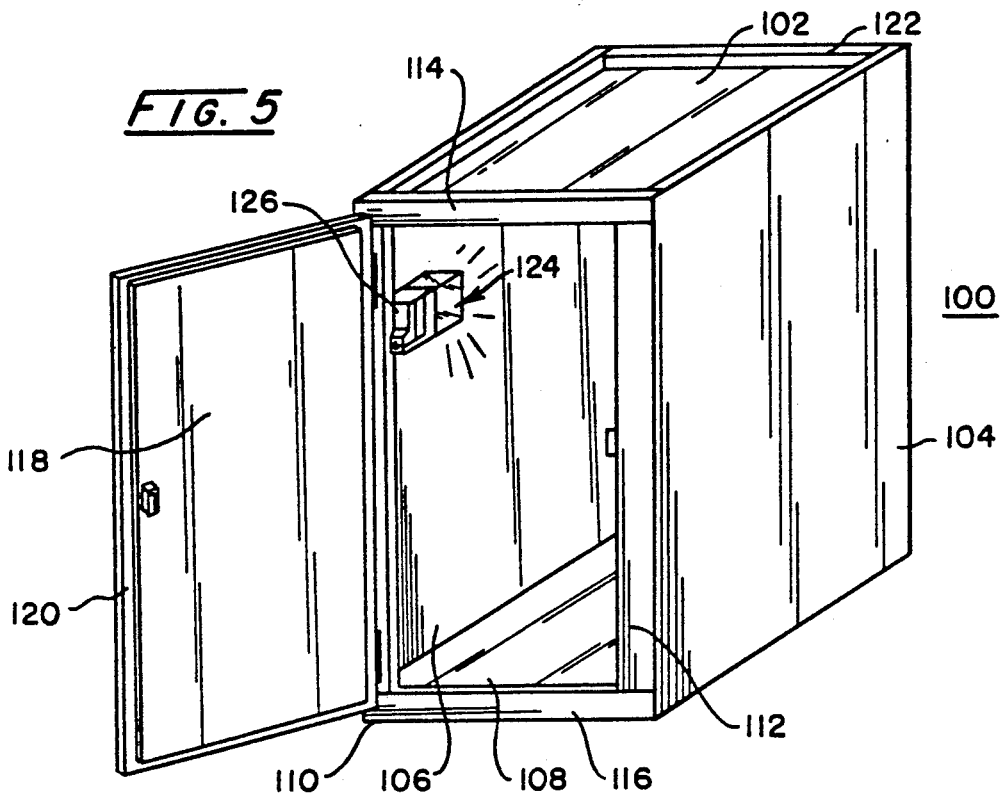
FIG. 6
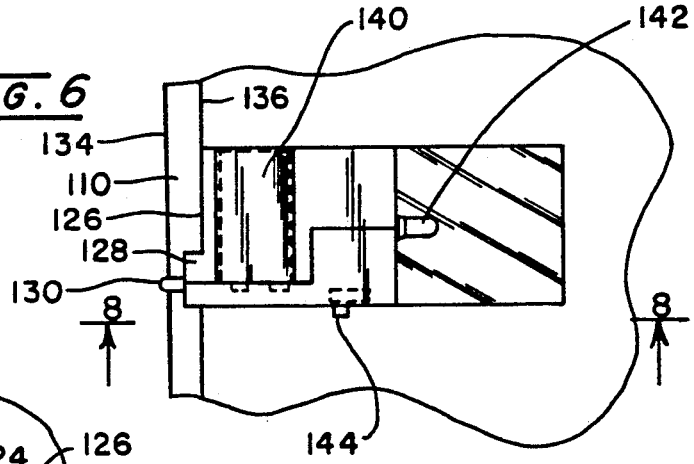
FIG. 7
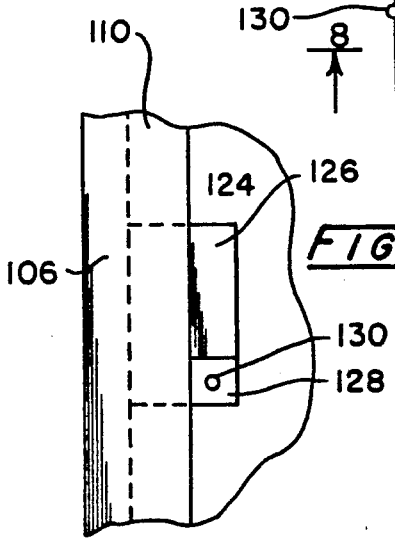
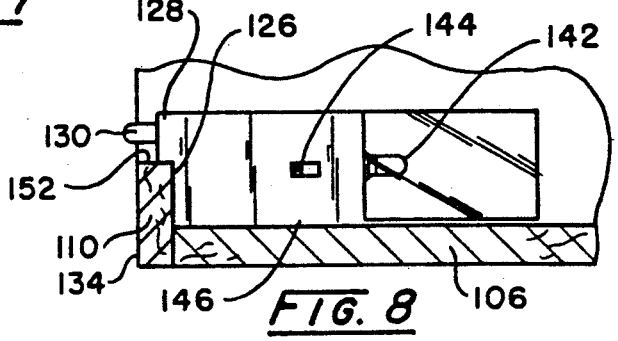
FIG. 8

CABINET LIGHT

FIELD OF THE INVENTION

This invention relates to an illumination device. More particularly it relates to an illuminating device for cabinets.

BACKGROUND OF THE INVENTION

Cabinets, as are typically found in the home, suffer from an inadequate illumination mechanism. Since the contents of these cabinets may contain dangerous materials such as drain cleaners, drugs, and other corrosive or poisonous materials, the lack of light in such areas presents a hazardous safety problem to those desiring to find various items in the cabinet. This can be a special problem for the elderly and other individuals who have failing eyesight and who may not be readily able to discern the materials they are seeking.

The lack of lighting in cabinets is largely the result of the fact that most cabinets are pre-built and then installed in the household setting. Typically they do not contain wiring that enables connection to the household wiring system. As such they often remain dark especially in those areas to the back of the cabinet and those cabinets that are not readily accessible to room lighting. Even though several inventors have attempted to provide lighting in various situations, none of them have specifically addressed the problem of cabinet lighting.

For example, Scholte (U.S. Pat. No. 2,156,462) shows an illuminating device particularly adapted for use in refrigerators or other enclosures that is operated by a plunger switch and dry-cell batteries. This device has a switch which can be used to render the device completely inoperative. As such the Scholte device would be unsuitable for areas beneath cabinets where it is desirable to activate the device rather than render it inoperative.

MacDonald U.S. Pat. No. 2,411,100 discloses a battery-operated closet light that is mounted on a panel above the closet door. Such a device is unsuitable for use with cabinets in that most cabinets do not have panels of sufficient size to accommodate the closet compartment device of MacDonald. Moreover MacDonald's device would be completely inoperative if not used in conjunction with the closet door.

Dubak, et al. U.S. Pat. No. 4,872,095 shows an entrance door nightlight is activated by the interaction of a storm door with a plunger on the light device. This door-light device can be set to work automatically or it can be left on continuously or off permanently. Because such a device is designed to direct the beam of light upon the lock set, it is ill-suited to the illumination requirements of a cabinet which require that the light be directed in several directions.

Marcus U.S. Pat. No. 4,178,626 discloses a drawer lighting apparatus in which the lamp assembly must be pivoted in order to activate the lighting means. The manual manipulation of such a device is ill-suited for use with most household cabinets.

Buteaux U.S. Pat. No. 4,577,262 discloses a storage container which is illuminated on opening the container lid. The light is mounted on the container lid and moves with the lid. The light is connected to batteries mounted on the container by means of a conduit.

Wells U.S. Pat. No. 2,279,933 discloses a lighting fixture that operates automatically in response to the opening and closing of a closet door. The device also has an on-off switch for permanently turning the light on inside of the closet when an individual is inside of the closet with the door closed. The lighting source is focused in a single downward direction.

Rogers U.S. Pat. No. 4,755,915 discloses a lighting apparatus that is mounted on a movable door. The light is activated by tilting the door.

Gibstein et al. (U.S. Pat. No. 4,332,007) discloses a utility light which achieves multi-direction illumination means of two or more light bulbs located within the device. The device has no automatic switch means for activating the device. The device uses a Velcro means for attaching the device to suitable "holders."

U.S. Pat. No. 4,754,376 discloses an automatic ice chest light that responds to the angle of the lid of the ice chest to activate the light. The light also has an on/off switch that allows for use of the light separate and apart from the ice chest.

Prebol et al. U.S. Pat. No. 2,774,860 discloses a battery-powered luggage device that has bulbs at both ends and is activated by a single plunger switch in response to the opening and closing of the luggage lid.

Although many lighting devices are disclosed in the prior art with many specific features, none are directed specifically toward the lighting of household cabinets that may be used both internally within the cabinet with the light source responding to the opening and closing of the cabinet door or alternatively being placed outside of the cabinet such as to provide lighting below and to the rear wall below the cabinet for eye-level cabinets.

SUMMARY OF THE INVENTION

The present invention solves the aforementioned problems in providing interior cabinet lighting by providing a device that turns on and off by responding to the action of the opening and closing of the cabinet door. The device is capable of providing lighting in closed cabinets, such as display cabinets with transparent fronts panels, by use of a manually operated on/off switch. The device is further designed especially for cabinet lighting in that it provides for the propagation of light in at least four directions within the cabinet while minimizing the amount of light directed to the front opening of the cabinet.

The illumination device is a battery-operated cabinet-door activated device to be used in conjunction with a cabinet assembly. The device has a housing that has two sections, an illuminating section and a circuitry section. In a preferred version, the illuminating section is open on four sides so as to project light through each of the open sides. When the housing is mounted on the sides of a cabinet, the open sides of the illuminating section allow light projection to the rear of the cabinet, to the bottom of the cabinet, to the top of the cabinet and to the opposite side of the cabinet while minimizing the projection of direct light into the observer's eyes. The illumination device uses a light source such as an incandescent bulb or high intensity lamp. The light source is placed in the illuminating section of the housing so as to project light through each of the four open sides.

A battery is mounted in the circuitry section of the housing. The circuitry section of the housing also contains electrical conductors such as wires or metallic strips for connecting the battery to the light source. A plunger switch is interposed in the circuitry and cooperates with the door of the cabinet so as to cause a connection to be formed between the battery and the light source when the door is open. The plunger switch disconnects the battery from the light source when the door is closed. A second switch is interposed into the circuitry so as to enable the light source to be turned on when the plunger switch is depressed, i.e., in the off position. Such a switch allows the illumination device to be used with cabinets having transparent, e.g., glass, or translucent door panels when the door is closed in order to provide "effect" lighting.

The illumination device may be modified by placing a third switch in the circuitry so as to disengage the plunger switch. With such a switch, the device may be mounted on an under surface of a cabinet such as an eye-level upper kitchen cabinet so as to illuminate the back wall and counter area below the cabinet.

The illumination device may also have a lens, such as a four-sided transparent lens, that cooperates with the illuminating section of the housing so as to cover the bulb. The transparent lens permits the light to project through the open side or sides of the illuminating housing. The lens and the illuminating section of the housing are provided with means for removably attaching the lens to the illuminating section of the housing. Such means permits the easy removal of the lens in order to replace the light source. The lens attachment may be made by means of a snap fit in which the interaction of projections and corresponding recesses integral with the illuminating housing and transparent lens allow firm attachment of the lens to the housing.

A reflector can be mounted in the illuminating section of the housing so as to focus and reflect the light from the light source in the direction of the side or sides of the illuminating section of the housing. Generally the reflector has a rectangular periphery that conforms to the closed bottom of the illuminating section of the housing and a rectangular periphery corresponding to the closed side of the illuminating section of the housing. The reflector may be modified and curved so as to generally reflect and focus light from the light source in the directions of the open sides of the illuminating section of the housing.

The circuitry section of the housing can have a cover that cooperates with the circuitry section housing so as to allow for the opening and closing of the circuitry section so as to enable changing of the battery. Such cooperation may be by tongue and groove type projections on the housing and the cover or by projections and matching depressions on the cover and housing so as to provide for a snap fit or both. The battery can be connected to the circuitry by means of one or more clips for engaging the terminals of the battery with the circuitry.

The illumination device is attached to the cabinet by any suitable means including nails, tacks, screws, and other suitable fasteners. Preferably the illuminating device is attached to the cabinet by means of a suitable adhesive. Such adhesive is of the contact type and is preferably provided by means of a two-sided contact-type adhesive tape. The illumination device is preferably mounted in the cabinet so as to be activated by the opening and closing of the door and arranged so that the four open sides of the illuminating section casts light toward the four opposite panels inside the cabinet, for example, from the side of the cabinet to the opposite side, top, bottom, and back and away from the door opening.

Alternatively the illuminating device may be mounted on the outside of the cabinet so as to provide external illumination. Preferably the illuminating device is mounted under a cabinet such as an upper eye-level kitchen cabinet so as to provide illumination to the counter and counter portion of the wall beneath the cabinet. When the device is used in such a fashion, a third switch is used to disengage the plunger switch.

In a preferred version of the cabinet light of this invention, the light device is used with a kitchen cabinet having a bottom, a top, two sides, and front trim members that form a lip that partially covers the front of the cabinet. The front trim is generally placed around the perimeter of the front opening of the cabinet. Typically, the trim forms an inside lip on the sides of the cabinet and an outside lip on the top and bottom.

The light assembly of this invention has a housing with a back that is attached to the interior side of the side member of the cabinet. The housing further has a side member that is generally perpendicular to the back member. This outer right angle corner of the housing generally conforms to the inner corner of the cabinet formed by the side and the front trim member. The side member of the light-assembly housing extends beyond the lip of the trim member so that a plunger switch housing can project toward the front of the cabinet the side of the trim member. The plunger-switch housing contains the plunger switch and positions the plunger switch so as to contact the cabinet door so that the plunger switch is depressed when the cabinet door is closed. The plunger switch housing preferably is set back from the face of the front trim member so as to accommodate recessed cabinet doors that extend partially into the front opening of the cabinet. For cabinet doors that are not recessed, the plunger housing may extend to a position that is flush with the face of the front trim member.

The light-assembly housing contains a light source such as a light bulb, a battery, and electrical conductors for connecting the battery to the light source. A plunger switch is interposed in the circuitry so as to turn off the light when the plunger switch is depressed. The light-assembly housing may also have a lens that covers the light source and is removable for access to the light source for changing the light source. A removable cover is provided for access to the battery. The conductors may also be provided with clips so as to facilitate the removal or connection of the battery.

It is the purpose of this invention to provide a maximum of lighting in an internal cabinet space in an automatic fashion that is dependent upon the opening and closing of the cabinet door.

It is a further purpose of this invention to accomplish this lighting purpose using battery power.

It is a further purpose of this invention to provide an illumination device that can be manually operated to provide a light source in closed cabinets with transparent or translucent door panels.

Other objects and features of this invention will be apparent and understood from the detailed description of the invention and the accompanying drawings which follow.

The foregoing and other advantages of the invention will become apparent from the following disclosure in which a preferred embodiment of the invention is described in detail and illustrated in the accompanying drawings. It is contemplated that variations in procedures, structural materials, and arrangement of parts may appear to the person skilled in the art without departing from the scope or sacrificing any of the advantages of the invention.

BRIEF DESCRIPTION OF THE DRAWINGS

FIG. 5 is a perspective view showing the illuminating device of this invention mounted on the side wall of a cabinet assembly having front trim members and a recessed door.

FIG. 6 is a front view of the device mounted on the side wall of a cabinet assembly with front trim members.

FIG. 7 is a side view of the device as installed on the side wall of a cabinet assembly with front trim members.

FIG. 8 is a partial cross sectional view of a cabinet assembly with front face trim showing a bottom view of the illuminating device and taken along lines 8—8 of FIG. 6.

DETAILED DESCRIPTION OF THE INVENTION AND BEST MODE FOR CARRYING OUT THE PREFERRED EMBODIMENT

Figure 1:
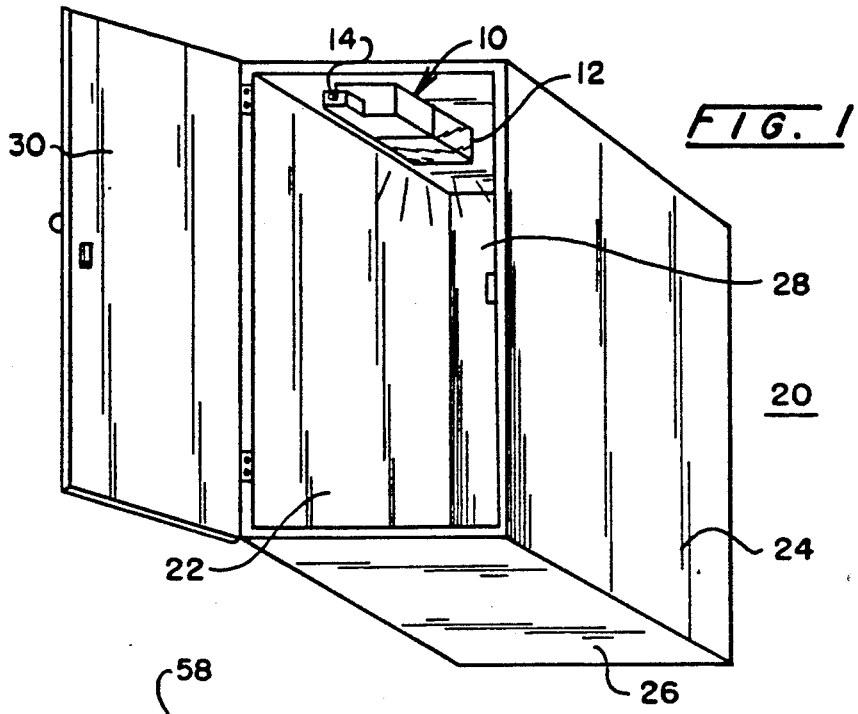
FIG. 1 is a perspective view showing the illuminating device of this invention mounted in a cabinet assembly with a door.
Figure 4:
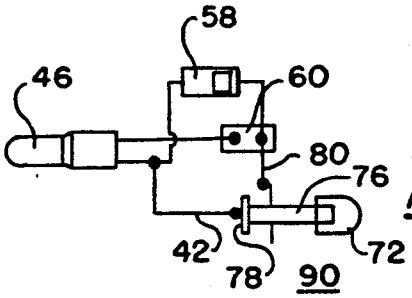
FIG. 4 is a schematic drawing of the electrical circuitry of the illumination device.

As shown in FIG. 1, the illuminating device 10 is mounted into a cabinet assembly 20 so that light radiates from the clear plastic lens in a direction so as to illuminate the sides 22 and 24, the bottom 26 and the back 28 of the cabinet. The door 30 engages contact switch 14 so as to turn off the light when the door 30 of the cabinet 20 is closed.

Figure 2:
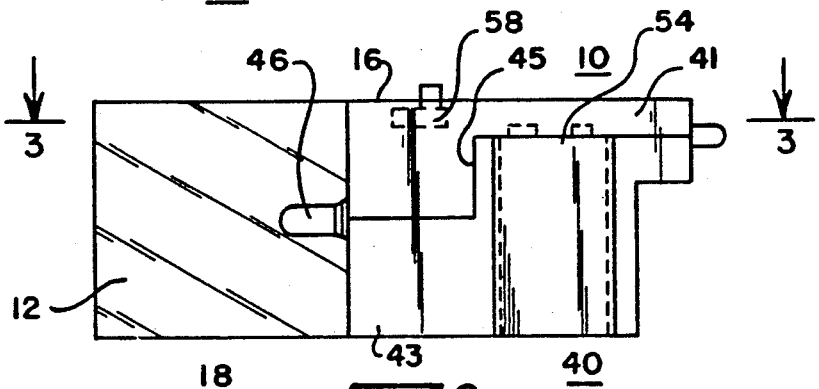
FIG. 2 is a front view of the device.
Figure 3:
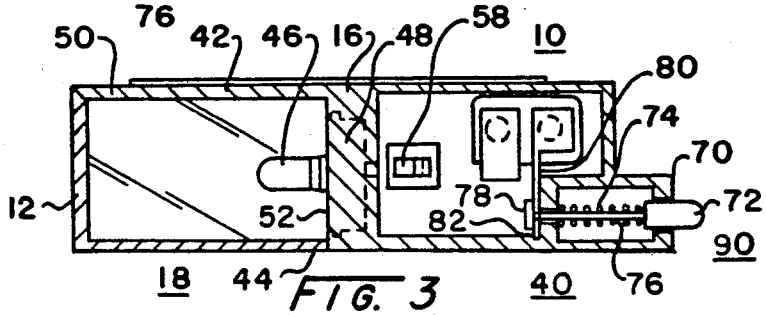
FIG. 3 is a top view and section along the lines 3—3 of FIG. 2.

As shown in FIGS. 2 and 3, the illuminating device 10 has a housing 16 that has an illuminating section 18 and a circuitry section 40. The illuminating section 18 has four open sides, a closed top member 42 that is a part of the housing 16 and a closed side member 44 that is also a part of housing 16. A lens 12 encloses the four open sides of the illuminating section of the housing 18 and interacts with the closed top 42 and side member 44 so as to engage and be fastened to said members 42 and 44. Such engagement may be accomplished by what is commonly referred to as a snap fit which is achieved by projections and corresponding depressions on the lens 12 and sides 42 and 44 so that the depressions and projections cooperate with each other so as to form a single assembly in which the lens 12 is easily removable from the remaining portion of the housing members 42 and 44.

The light source 46 is secured to the housing 16 by suitable means. For example, as shown in FIG. 3 the illuminating means such as an incandescent lamp or high intensity light may be secured to the housing 16 by means of any suitable retainer 48. The lamp or light may be held in place by bayonet-type mounting or a threaded assembly. As shown in FIG. 2, the housing 16 may be made in two sections, a top section 41 and a bottom Section 43 joined along surface 45 so as to allow for easy assembly of the various components into the housing.

A reflector composed of members 50 and 52 and mounted within the illuminating section 18 of the housing 16 focuses and reflects light from the light source 46 through the open sides of the illuminating section 18 of housing 16. The reflector members 50 and 52 are adapted to removably engage housing member 42 and 44 by means of snap in place geometrical features associated with both the reflector and the housing. The reflector portion 50 generally has a rectangular periphery as does reflector portion 52, conforming generally to the top section 42 and the side section 44 of the housing 16. Reflector portions 50 and 52 may also be formed as a single piece in a trough type shape so as to reflect the light outwardly through the four open sides of the illuminating section 18 of the housing 16. The reflector portions may be fabricated of plastic or metal. If the reflector portions are plastic, a metal coating may be produced on its surface by vacuum sputtering treatment with aluminum, wet plating with nickel or other known techniques including the use of a metalized adhesive tape.

The circuitry section 40 of the housing 16 has a cover 54 that cooperates with the housing in suitable fashion such as by means of a tongue and groove assembly in the corresponding circuitry section 40 of housing 16 and cover plate 54 or a snap fit assembly achieved by suitable projections and depressions on the corresponding circuitry section 40 of housing 16 and cover 54 or a combination of both tongue and groove assembly and snap fit.

A battery 60 (shown in phantom in FIG. 2) is contained in the circuitry section 40 of the housing 16 and is accessible by removing the circuitry section cover 54 from the housing so as to facilitate replacement of the battery. The plunger switch 90 is contained in housing 70 which is an integral part of housing 16. The plunger switch 90 consists of a plunger button 72 that contacts the cabinet door 30, a plunger switch shaft 76 that connects the plunger button 72 with the contacting plate 78. A spring 74 biases the plunger assembly in an outward position so as to bring the contact plate 78 into contact with electrical conductors 80 and 82 so as to complete the circuit between the battery and the light source 46.

A slide switch 58 operates between the battery 60 and the light source 46 whereas to complete the circuit and illuminate the light when the plunger 72 is in the depressed position. As a result, the illuminating device may be left on where the cabinet door is closed to provide "effect" lighting for cabinet doors with transparent or translucent front panels (not shown).

The illuminating device 10 may be attached to the cabinet 20 by suitable fastening means such as screws, nails, and similar devices. Preferably the illuminating device 10 is attached to the cabinet 20 using an adhesive means such as a double sided adhesive tape 96. A peel off release paper may be applied to the double sided tape and removed just prior to mounting the illuminating device on the cabinet.

FIG. 5 shows the cabinet light of this invention incorporated into a cabinet structure 100 that is typical of cabinets found in many kitchens and bathrooms. Cabinet structure 100 consists of a top 102, a bottom 108, a side 106, a second side 104, and a back member 122. Typical of this type of cabinet structure is a front trim consisting of top trim member 114, a bottom trim member 116, and side trim members 110 and 112. A wide variety of methods can be used to join these front trim members to the cabinet structure, including a wide variety of known joinery methods to be used at the corners of the face trim assembly.

In a typical assembly such as that shown in FIG. 5, the side trim members 110 and 112 form an innerlip with the sides of the cabinet while the top 114 and bottom 116 trim members form an outer lip with the top and bottom members of the cabinet. In such an arrangement the outside of sides 104 and 106 are flush with time members 110 and 112 while the inside surface of the top 102 and bottom 108 are flush with trim members 114 and 116.

The cabinet light 124 is preferably mounted on a side wall such as wall 106 immediately behind the side trim member 110. As shown in FIG. 7, the cabinet light 124 is mounted behind the front trim member 110 to side member 106 (shown in phantom). The side 126 of the cabinet light 124 extends beyond front the trim member 110. As shown in FIGS. 5, 6, and 8, a plunger housing 128 extends from the side 126 of the cabinet light housing toward the front of the cabinet.

Figure 9:
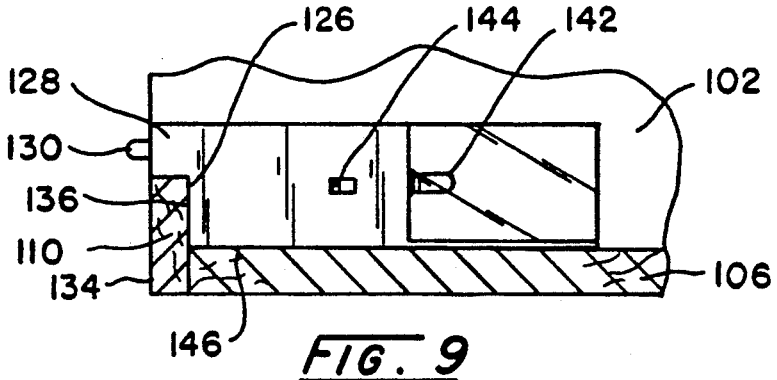
FIG. 9 is an alternate version of FIG. 8 showing the plunger switch housing extending to the front of the face trim.

Since the cabinet door 118 has a lip 120 which allows the cabinet door 118 to extend into the front opening of the cabinet assembly 100 (FIG. 5), it is preferred that the plunger switch housing 128 extend only partially along the side 152 (FIG. 8) of cabinet trim member 110 to the front thereof so as to allow cabinet door 118 to properly close into the cabinet front opening. For cabinet doors that are not recessed into the front opening, the housing can extend to the front edge of the cabinet (FIG. 9). When the plunger switch housing 128 is of such length as to extend for the full width of side trim member 110, that is from the backside 136 to the front side 134 of trim member 110, recessed doors such as 118 can be accommodated by withdrawing the cabinet light slightly to the rear of the cabinet so as to form a gap between the backside 36 of side trim 110 and the side 126 of the cabinet light device.

The cabinet light 124 also contains a battery 140 and a light 142. Optionally the cabinet light may contain a second switch for turning on light 142 for use in a cabinet having transparent or translucent front panels so as to allow the light to remain on when the cabinet door is closed such as to provide effect lighting in display cabinets. The cabinet light is preferably mounted to cabinet side 106 by means of a two sided tape 146.

Preferably the cabinet light 124 is installed on the side of the cabinet to which the cabinet door 118 is hinged. By installing the cabinet light 124 in such a position, the cabinet light will not turn on when the door is only slightly ajar. Although the light 124 is shown as a generally rectangular structure, it is to be understood that other shapes are possible including devices with rounded shapes. However, whatever shape the device assumes, it is preferred that at least the back, one side, and the plunger housing conform to the side and front trim lips so as to enable proper closing of the door with attendant functioning of the plunger switch.

It may be possible that changes in the configurations to something other than that shown could be used but that which is shown is preferred and typical. Without departing from the spirit of this invention, various means for fastening the materials together may be used.

It is therefore understood that although the present invention has been specifically disclosed with the preferred embodiment and examples, modifications to the design concerning sizing and shape may be apparent to those skilled in the art, and such modifications and variations are considered to be within the scope of the invention and the appended claims.

I claim:

1. A cabinet and light assembly comprising:

a. a cabinet comprising two sides, a back, a bottom, a top, and at least two front side trim members extending partially over a front side of said cabinet to form a side lip;

b. a door attached to said cabinet and cooperating with said cabinet so as to open and close said cabinet;

c. a light-assembly housing having a back attached to an interior side of said cabinet behind said side lip and having a side generally perpendicular to said back and contacting a rear surface of said side lip and extending along and beyond said rear surface of said side lip and into the front opening area of said cabinet;

d. a light source affixed to said light-assembly housing;

e. a battery contained in said light-assembly housing;

f. electrical conductors in said light-assembly housing for connecting said battery to said light source;

g. a plunger switch interposed in said circuitry; and h. a housing for covering said plunger switch, said plunger switch housing extending forward from an exposed portion of said side of said light-assembly housing extending beyond said side lip with a side of said plunger switch housing being in contact with an interior side of said front trim member; and j. a plunger button movably projecting from an end of said plunger switch housing so as to allow said plunger button to contact said door of said cabinet and thereby operate said plunger switch.

2. A battery-operated self-activated illumination device according to claim 1 further comprising a lens cooperating with said light-assembly housing so as to cover said light source.

3. A battery-operated self-activated illumination device according to claim 2 wherein said lens is detachably affixed to said light-assembly housing so as to provide access to said light source.

4. A battery-operated self-activated illumination device according to claim 1 further comprising a reflector for focusing said light source.

5. A battery-operated self-activated illumination device according to claim 1 further comprising a cover for said light-assembly housing so as to allow access to said battery.

6. A battery-operated self-activated illumination device according to claim 1 further comprising one or more clips for engaging terminals of said battery so as to facilitate changing of said battery.

7. A battery-operated self-activated illumination device according to claim 1 wherein said light-assembly housing is attached to said cabinet by means of a two-sided adhesive tape.

8. A battery-operated self-activated illumination device for a cabinet assembly having a sidewall and a side trim member, said illumination device comprising:

a. a light-assembly housing having an illuminating section open so as to project light and a circuitry section;

b. a light source contained in said illuminating section of said housing so as to project light;

c. a battery contained in said circuitry section of said housing;

d. electrical conductors in said circuitry section for connecting said battery to said light source;

e. a plunger switch interposed in said circuitry and cooperating with a door of said cabinet so as to cause a connection to be formed between said battery and said light source when said door is opened and to disconnect said battery from said light source when said door is closed;

f. a switch interposed in said circuitry so as to enable turning said light source on independent of said plunger switch g. a plunger switch housing covering said plunger switch and projecting from a side of said light-assembly housing so that a back and said side of said light-assembly housing and a side of said plunger housing form a contiguous surface that contacts a contiguous surface of an interior side of said cabinet side wall, a backside of said side trim member and an interior side of said trim member; and h. a plunger button movably projecting from an end of said plunger switch housing so as to allow said plunger button to contact said door of said cabinet and thereby operate said plunger switch.

9. A battery-operated self-activated illumination device according to claim 8 further comprising a transparent lens cooperating with said illuminating section of said housing so as to cover said illuminating section and means for affixing said lens to said illuminating section of said housing.

10. A battery-operated self-activated illumination device according to claim 9 wherein said means for affixing said lens to said illuminating section of said housing allows for the removal and attachment of said lens to said housing so as to enable changing of said light source.

11. A battery-operated self-activated illumination device according to claim 8 further comprising a reflector mounted in said illuminating section of said housing for focusing light from said light source.

12. A battery-operated self-activated illumination device according to claim 8 further comprising a cover cooperating with said circuitry section of said housing so as to allow opening and closing of said circuitry section so as to enable changing of said battery.

13. A battery-operated self-activated illumination device according to claim 8 further comprising one or more clips for engaging the terminals of said battery with the electrical conductors so as to enable changing of said battery.

14. A battery-operated self-activated illumination device according to claim 8 further comprising means for attaching said housing to said cabinet.

15. A battery-operated self-activated illumination device according to claim 14 wherein said means for attaching said housing to said cabinet is a two-sided adhesive tape.

16. A cabinet and light assembly comprising:

a. a cabinet comprising two sides, a back, a bottom, a top, and at least two front side trim members partially extending over a front side of said cabinet to form a side lip.

b. a door attached to one said front side trim member and cooperating with said cabinet so as to open and close said cabinet;

c. a light-assembly housing having an illuminating section open so as to project light and a circuitry section, with a back of said light-assembly housing being attached to an interior side of said cabinet side and a contiguous side of said light-assembly housing being partially behind and contacting a backside of one of said front side trim members;

d. means for attaching said light-assembly housing to said interior side of said cabinet;

e. a light source affixed to said illuminating section of said housing so as to illuminate the interior of said cabinet;

f. a battery contained in said circuitry section of said housing;

g. electrical conductors in said circuitry section for connecting said battery to said light source;

h. a plunger switch interposed in said circuitry and cooperating with said door of said cabinet so as to cause a connection to be formed between said battery and said light source when said door is opened and to disconnect said battery from said light source when said door is closed;

i. a housing for covering said plunger switch, said plunger switch housing extending forward from an exposed portion of said side of said light-assembly housing partially behind and contacting the backside of said front trim member with a side of said plunger switch housing being in contact with an interior said of said front trim member; and j. a plunger button movably projecting from an end of said plunger switch housing so as to allow said plunger button to contact said door of said cabinet and thereby operate said plunger switch.

17. A battery-operated self-activated illumination device according to claim 16 further comprising a transparent lens cooperating with said illuminating section of said housing so as to cover said illuminating section while permitting light to project therethrough with means for affixing said lens to said illuminating section of said housing.

18. A battery-operated self-activated illumination device according to claim 17 wherein said means for affixing said lens to said illuminating section of said housing allows for the removal and attachment of said lens to said housing so as to enable changing of said light source.

19. A battery-operated self-activated illumination device according to claim 16 further comprising a reflector for focusing said light source.

20. A battery-operated self-activated illumination device according to claim 16 further comprising a cover cooperating with said circuitry section of said housing so as to allow opening and closing of said circuitry section so as to enable changing of said battery.

21. A battery-operated self-activated illumination device according to claim 16 further comprising one or more clips for engaging the terminals of said battery so as to enable changing of said battery.

22. A battery-operated self-activated illumination device according to claim 9 wherein said means for attaching said housing to said cabinet is a two-sided adhesive tape.

* * * * *